US006928846B2

(12) United States Patent
Furuse

(10) Patent No.: US 6,928,846 B2
(45) Date of Patent: Aug. 16, 2005

(54) METHOD OF MANUFACTURING A COIL SPRING HAVING AN OBLIQUE AND STRAIGHT AXIAL LINE

(75) Inventor: Takeshi Furuse, Kanagawa (JP)

(73) Assignee: NHK Spring Co., Ltd., Kanagawa (JP)

( * ) Notice: Subject to any disclaimer, the term of this patent is extended or adjusted under 35 U.S.C. 154(b) by 139 days.

(21) Appl. No.: 10/348,938

(22) Filed: Jan. 22, 2003

(65) Prior Publication Data

US 2004/0000180 A1 Jan. 1, 2004

(30) Foreign Application Priority Data

Jun. 26, 2002 (JP) ..... 2002-185941

(51) Int. Cl.[7] ..... B21F 3/02
(52) U.S. Cl. ..... 72/138; 72/145
(58) Field of Search ..... 72/138, 145

(56) References Cited

U.S. PATENT DOCUMENTS 4,903,985 A 2/1990 Muhr et al.
6,550,301 B2 * 4/2003 Hasegawa ..... 72/138
2003/0042238 A1 3/2003 Koga et al.

FOREIGN PATENT DOCUMENTS

JP 1156119 A 6/1989
JP 2001246470 A 9/2001
JP 20022035887 A 2/2002

* cited by examiner

*Primary Examiner*—Lowell A. Larson
(74) *Attorney, Agent, or Firm*—Marshall & Melhorn, LLC

(57) ABSTRACT

In a cold coil forming process, a pitch control tool is moved in synchronism with the displacement of the outer diameter control roller so as to form a coil spring having a straight and oblique axial line, and, at the same time, maintain a pitch of the coil wire substantially constant substantially over an entire length thereof. Thus, the method of the present invention can be implemented by using a conventional coiling machine only if the outer diameter control roller and the pitch control tool can be adjusted as required by the present invention. In particular, the pitch of the coil spring can be kept constant over each turn of the coil wire without regard to the variation in the radius of curvature of the coil spring.

4 Claims, 4 Drawing Sheets

METHOD OF MANUFACTURING A COIL SPRING HAVING AN OBLIQUE AND STRAIGHT AXIAL LINE

TECHNICAL FIELD

The present invention relates to a coil spring having an oblique and straight axial line, and in particular to a method of manufacturing a coil spring suitable for use in vehicle wheel suspension systems.

BACKGROUND OF THE INVENTION

The strut type wheel suspension system is widely used in automobiles. Such a wheel suspension system typically comprises a wheel carrier, a link member joining the wheel carrier to the vehicle body, a tubular shock absorber including a cylinder filled with oil and a piston slidably received therein extending approximately vertically between the wheel carrier and vehicle body and a coil spring surrounding the shock absorber. The shock absorber receives a force input from the wheel carrier, but the direction of this force input typically does not coincide with the axial line of the shock absorber. The resulting lateral force component produces a lateral force and a moment at the sliding part between the piston and cylinder, and this in turn causes a frictional resistance between them. This not only impairs the ride quality of the vehicle, but reduces the service life of the shock absorber.

To mitigate this problem, it has been proposed to mount the coil spring in such a manner that the axial line of the coil spring is angularly offset from the axial line of the shock absorber. The lateral force and moment which are produced by the coil spring and applied to the shock absorber can be used for canceling those produce by the force input from the wheel carrier. However, the possible amount of offset is dictated by the diameter of the coil spring and the available mounting space, and it is difficult to produce adequate amounts of lateral force and moment from the coil spring.

Japanese patent laid open publication (kokai) No. 1-156119 discloses a coil spring having a curved axial line in its free state. It is discussed that the curved coil spring produces a lateral force and moment that can cancel those produced at the sliding part between the cylinder and piston of the shock absorber. It is however not clear how this curved coil spring can be mounted and retained in a straight disposition. Producing such curved coil springs on a commercial basis would be difficult because cost considerations are highly important for coil springs for vehicle suspension systems.

Japanese patent application No. 2000-562229 by the assignee of the present application discloses a coil spring having a vertical and straight axial line and a pitch angle that varies in each turn in a cyclic manner. This coil spring has a cylindrical profile, and can be installed in a limited space. Furthermore, it can be easily installed as there is no need to support any lateral force when installing it. This coil spring can be most conveniently produced in a hot coiling process, but there is some difficulty in producing it in a cold process which involves the use of feed rollers.

Japanese patent laid open publication No. 2002-35877 discloses a method of manufacturing an oblique coil spring suited to be produced in a cold coiling process. Although the coil spring has an oblique but straight axial line, a lateral force is produced as it extends and compresses. It therefore can be favorably used in a vehicle wheel suspension system. However, the proposed method is an attempt to form an oblique coil spring simply by adjusting the turn radius (radius of curvature) of the coil spring.

However, according to the conventional coiling machine, as the radius of curvature of the coil spring changes from one point to another, the lateral distance between the roller for controlling the outer diameter and a tool for controlling the pitch changes, and this causes the pitch angle of the coil spring to be uneven from one point to another in each turn. Such a variation in the pitch angle causes the pitch at each point of the turn to be uneven, and this unevenness accumulates over the length of the coil spring with the result that the axial line of the coil spring tends to curve significantly.

Even when the axial line of the coil spring is curved, it still can produce a lateral force as it extends and compresses. However, such a coil spring would require a relatively large mounting space as was the case of the coil spring mounted with an offset with respect to the axial line of the shock absorber, and would be unable to produce an adequately large lateral force.

BRIEF SUMMARY OF THE INVENTION

In view of such problems of the prior art, a primary object of the present invention is to provide a method of manufacturing a coil spring having a straight and oblique axial line which is suited to be carried out as a cold coiling process.

A second object of the present invention is to provide such a method which is suited to be implemented as a mass production process.

A third object of the present invention is to provide such a method which is suitable for use in a strut type vehicle wheel suspension system and can simplify the assembly work.

A fourth object of the present invention is to provide such a method which is suitable for use in a strut type vehicle wheel suspension system and can reduce the frictional resistance between the cylinder and piston of the shock absorber.

According to the present invention, these and other objects can be accomplished by providing a method of manufacturing a coil spring having a straight and oblique axial line, comprising the steps of: feeding a rod member along an axial line thereof; applying an outer diameter control roller to the rod member from a first direction which is substantially perpendicular to the axial line; applying a pitch control tool from a second direction substantially perpendicular to both the axial line of the rod member and the first direction; displacing the outer diameter control roller cyclically so as to form a first section having a relatively large effective radius of curvature and a second section having a relatively small effective radius of curvature in each turn of the coil spring; and displacing the pitch control tool in the second direction in synchronism with the displacement of the outer diameter control roller so as to maintain a pitch of the coil wire substantially constant substantially over an entire length thereof.

Thus, the method of the present invention can be implemented by using a conventional coiling machine only if the outer diameter control roller and the pitch control tool can be adjusted as required by the present invention. In particular, by synchronizing the motion of the pitch control tool with the motion of the outer diameter control roller, the pitch of the coil spring can be kept constant over each turn of the coil wire without regard to the variation in the radius of curvature of the coil spring, and a coil spring having a straight and oblique axial line can be manufactured. In particular, the coil spring can be wound as a cold coil forming process.

The pitch control tool is preferably displaced such that $\Delta P=A(\Delta D/D)P$ holds, where P is an offset of the pitch control tool with respect to a reference plane corresponding to a zero pitch, $\Delta P$ is the displacement of the pitch control tool, D is the distance between the pitch control tool and outer diameter control roller, $\Delta D$ is the displacement of the outer diameter control roller, and A is a constant value.

To simplify the assembly work, at least one end of the coil spring may be provided with an end turn portion wound substantially perpendicularly to the oblique axial line of the coil spring. The end turn may consist of either a closed end or an open end as required.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
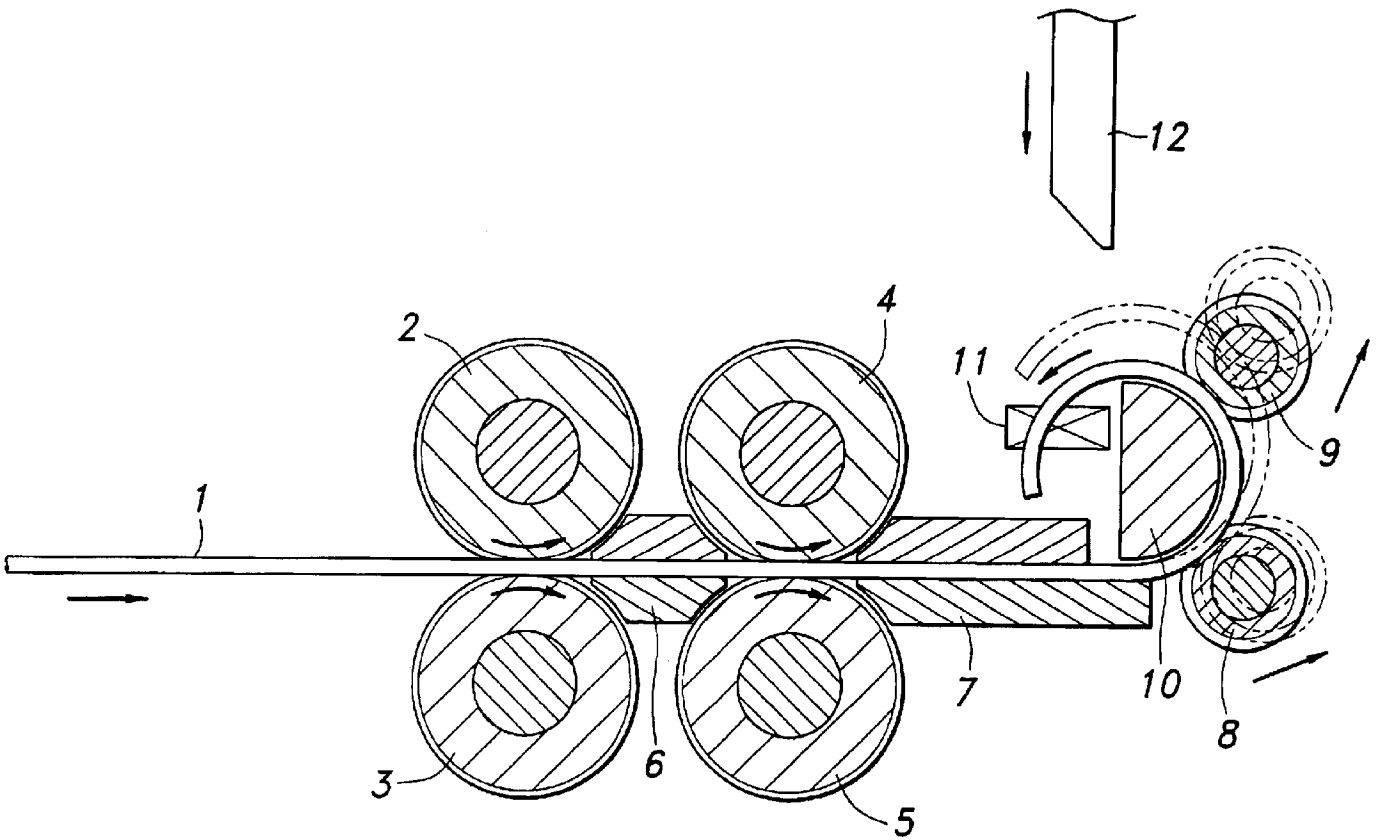
FIG. 1 is a schematic front view of a coiling machine suitable for implementing the method of the present invention.
Figure 2:
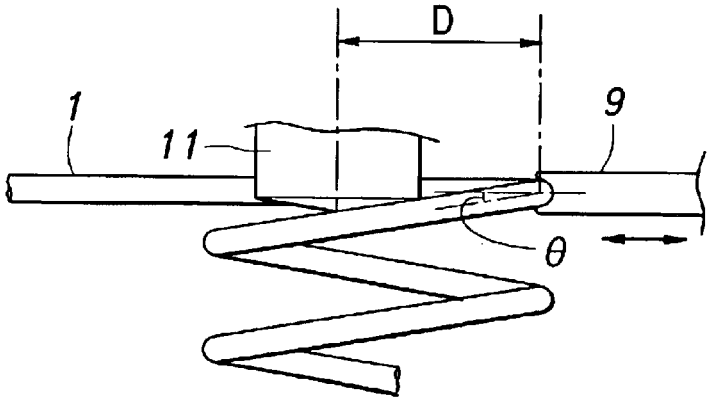
FIG. 2 is a fragmentary plan view of a part of the coiling machine shown in FIG. 1.

FIGS. 1 and 2 show a coiling machine that can be used for implementing the method of manufacturing a compression coil spring according to the present invention. A rod member 1 serving as the material for the coil spring is fed rightward in FIG. 1 by two pairs of feed rollers 2 to 5. To prevent the rod member 1 from buckling in spite of the axial force that is produced by the feed action of the feed rollers, the rod member is closely surrounded by guide members 6 and 7.

The downstream end of the rod member 1 which is pushed out of the guide members 7 is passed between a first outer diameter control roller 8 and a core metal 10 having a semi-cylindrical shape, and then between a second outer diameter control roller 9 and the core metal 10 so that the rod member 1 is thereby given with a required radius of curvature. The first outer diameter control roller 8, second outer diameter control roller 9 and feed rollers 2 to 5 are all located on a same reference plane which is parallel to the sheet of paper of FIG. 1. The rod member 1 which has bee passed out of the second outer diameter control roller 9 is engaged by a pitch control tool 11 which is offset perpendicularly away from this reference plane so that the rod member is deformed in the axial direction of the coil and is given with a required pitch angle.

Once a required length of coil is wound by feeding the rod member continuously, a cutting blade 12 is applied to the rod member 1, and cut the rod member 1 against the core metal 10. By repeating this process, a large number of coil springs can be continuously produced as a cold forming process.

A coiling machine of this type is typically equipped with the function to axially displace the pitch control tool during the forming process for such purposes as forming closely wound end turns. Some of the coiling machines are capable of displacing the outer diameter control rollers for the purposes of forming elliptic or track-shaped coil springs and non-cylindrical coil springs (such as tapered, barrel-shaped and hourglass-shaped coil springs). It is possible to wind a coil spring having a straight but oblique axial line by using such a coiling machine.

Figure 3:
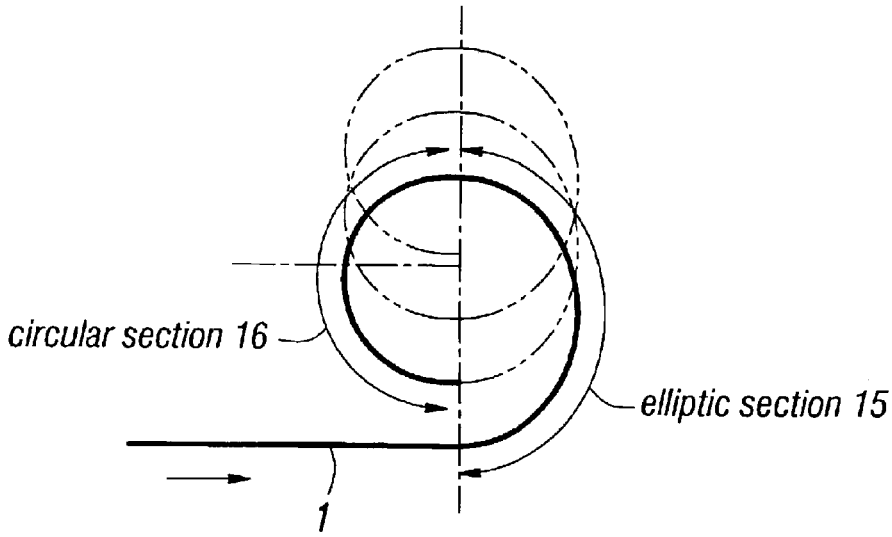
FIG. 3 is a diagram showing the mode of winding a coil spring having an oblique axial line.

More specifically, by moving the outer diameter control rollers 8 and 9 in the directions indicated by arrows (FIG. 1) and forming, for each turn of the coil spring, an elliptic or track-shaped section 15 and a circular section 16 in an alternating manner as illustrated in FIG. 3, a coil spring having a straight but oblique axial line can be formed. In this case, the length of each section or the coil wire length of each section can be freely selected as long as the two sections having different effective radii of curvature occur for each turn of the coil substantially over the entire length of the coil spring. Typically, these sections each extend approximately over the angle of 180 degrees. Also, the elliptic or track-shaped section 15 may consist of a pure elliptic section, a track-shaped section or a combination of a plurality of sections each provided with a certain radius of curvature and smoothly connected to each other. Similarly, the circular section 16 may be modified from a pure circular shape so as to be consistent with the elliptic or track-shaped section.

In practice, an end turn portion defining a coil end substantially perpendicular to the oblique axial line of the coil spring may be provided in one of or each of the ends, or a suitable spring seat may be used if desired.

It should be possible to form a coil spring having an oblique axial line by carrying out the process described above. However, in reality, in winding such a coil spring by using a normal coiling machine, an additional factor is required to be taken into consideration. This is explained in the following with reference to FIG. 4.

Figure 4:
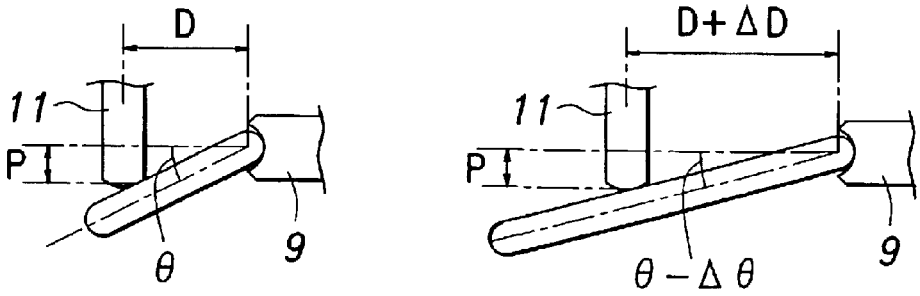
FIG. 4 is a diagram showing how the displacement of the outer diameter control roller affects the pitch of the coil spring according to the prior art.

In a normal coiling machine, whereas the positions of the outer diameter control rollers 8 and 9 can be adjusted in a reference plane, the pitch control tool 11 can only move in the axial direction and is unable to move in the plane of the outer diameter control rollers 8 and 9. Therefore, when the outer diameter control roller 9 is displaced so as to continuously change the radius of curvature of the coil spring, as shown in FIG. 4, the distance between the pitch control tool 11 and the outer diameter control roller 9 changes from D (for winding the circular section 16) to $D+\Delta D$ (for winding the elliptic or track-shaped section), and this in turn causes a change in the pitch angle which is given to the coil spring by the pitch control tool 11 from $\theta$ to $\theta-\Delta\theta$. If the offset of the pitch control tool 11 from the reference plane (the position of the pitch control tool 11 for zero pitch angle) is P, then $P=D \tan\theta=(D+\Delta D)\tan(\theta-\Delta\theta)$. Therefore, when the radius of curvature of the coil spring is increased, the pitch angle of the corresponding part of the coil wire decreases from the reference value.

Figure 5:
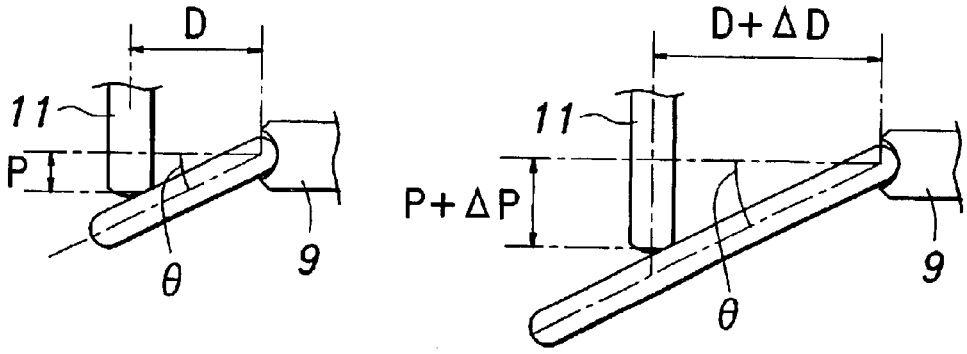
FIG. 5 is a diagram showing how the displacement of the outer diameter control roller is prevented from affecting the pitch of the coil spring according to the present invention.
Figure 6:
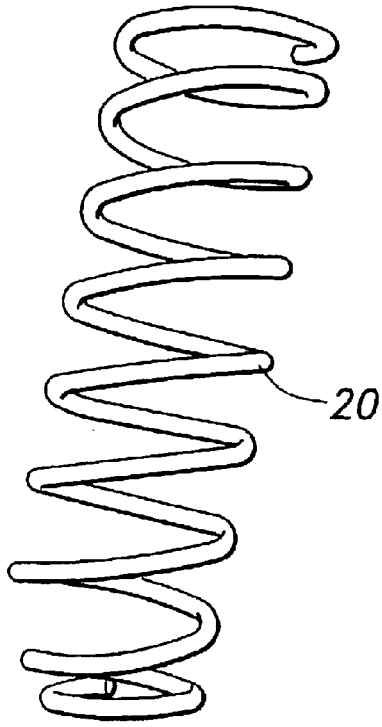
FIG. 6 is a perspective view showing a coil spring having a straight and oblique axial line manufactured by the method of the present invention.

Based on such considerations, it can be concluded that the dimension P is required to be changed in a certain way for the pitch angle $\theta$ to be kept constant without regard to the change in the distance between the pitch control tool 11 and the outer diameter control roller 9. As shown in FIG. 5, as the distance between the pitch control tool 11 and the outer diameter control roller 9 changes from D (for winding the circular section 16) to D+ΔD (for winding the elliptic or track-shaped section 15), it is assumed that the displacement of the pitch control tool 11 from the reference plane that is required for keeping the pitch angle constant at the value θ is P+ΔP. Then, P+ΔP=(D+ΔD) tan θ=(D+ΔD) (P/D), and if ΔP=(ΔD/D)P, the pitch angle can be kept at the constant value θ irrespective of the distance between the pitch control tool 11 and the outer diameter control roller 9. FIG. 6 illustrates a coil spring 20 which is wound in this fashion and is provided with a straight and oblique axial line.

Figure 7:
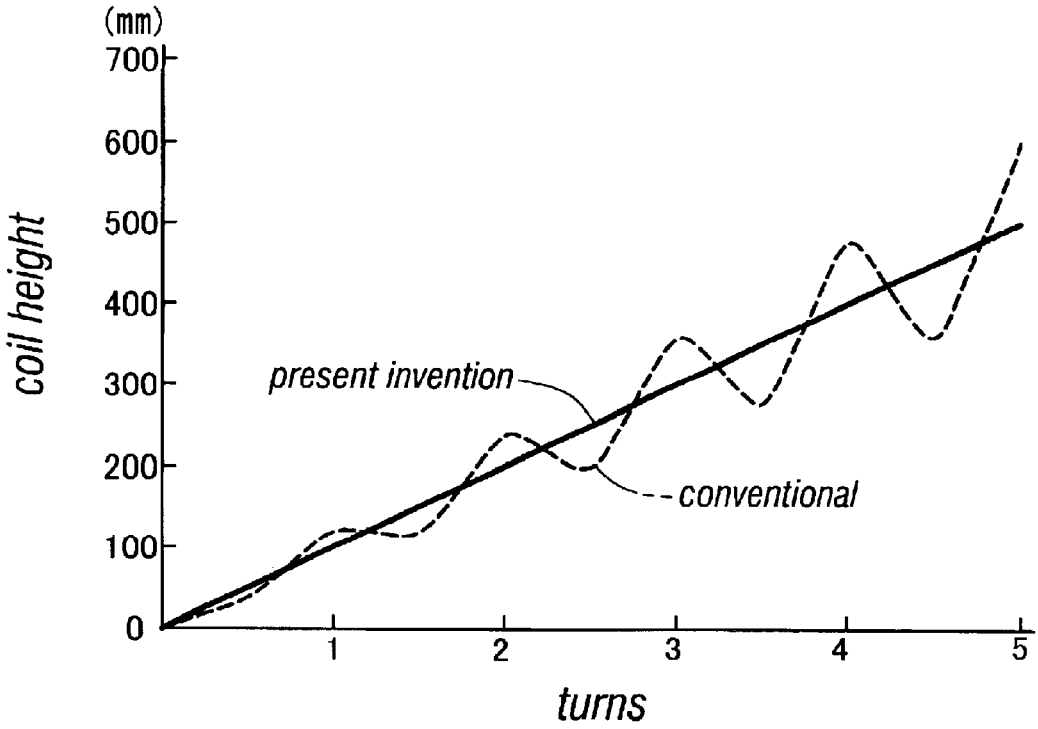
FIG. 7 is a graph comparing the configuration of the coil spring wound according to the present invention to that wound according to the prior art.

FIG. 7 is a graph showing the relationship of the spring height as measured from a horizontal reference plane with respect to the number of turns of the coil spring. When only the outer diameter of the coil spring is controlled, the change in the spring height or the pitch cyclically changes as indicated by the broken line. On the other hand, when the axial position of the pitch control tool is controlled as well as the outer diameter of the coil spring according to the present invention, the change in the spring height in relation to the number of turns or the pitch can be kept constant as indicated by the solid line.

In practice, there are other factors that could affect the configuration of the coil spring, and it is not easy to accurately evaluate the contribution of each factor. For instance, the coil wire length is in general different between the circular section and elliptic or track-shaped section even when they span over a same angle, and the pitch is not the same between them even when the pitch angle is kept constant over the entire length of the coil wire. Also, as the distance between the pitch control tool 11 and the outer diameter control roller 9 increases, the spring back of the coil spring increases. Therefore, to keep the pitch angle constant, it is necessary to displace the pitch control tool 11 so as to compensate for the particular amount of spring back. However, according to the experiments conducted by the inventors, it was demonstrated that a coil spring having a substantially straight, oblique axial line can be obtained by displacing the pitch control tool 11 substantially in proportion to the distance between the pitch control tool 11 and the outer diameter control roller 9. Therefore, it is sufficient for practical purposes to approximately determine the necessary displacement of the pitch control tool 11 according to the principle illustrated in FIG. 5, and make minor adjustments to the displacement of the pitch control tool 11 by experimentally evaluating the straightness of the coil spring formed according to such a principle.

Although the present invention has been described in terms of a preferred embodiment thereof, it is obvious to a person skilled in the art that various alterations and modifications are possible without departing from the scope of the present invention which is set forth in the appended claims.

For instance, the present invention can be applied not only to cylindrical coil springs, but may also be applied to other coil springs such as conical coil springs, hourglass-shaped coil springs, barrel-shaped coil springs and tapered coil springs. The present invention is suited to be implemented as a cold forming process, but may also be applied to a hot forming process. The field of application of the present invention is not limited to strut and other vehicle wheel suspension systems, but is applicable to any industrial or vehicle applications.

What is claimed is:

1. A method of manufacturing a coil spring having a straight and oblique axial line, comprising the steps of:

feeding a rod member along an axial line thereof;

applying an outer diameter control roller to said rod member from a first direction which is substantially perpendicular to said axial line;

applying a pitch control tool from a second direction substantially perpendicular to both said axial line of said rod member and said first direction;

displacing said outer diameter control roller cyclically so as to form a first section having a relatively large effective radius of curvature and a second section having a relatively small effective radius of curvature in each turn of said coil spring; and displacing said pitch control tool in said second direction in synchronism with the displacement of said outer diameter control roller so as to maintain a pitch of said coil wire substantially constant substantially over an entire length thereof;

wherein said pitch control tool is displaced such that ΔP=A(ΔD/D)P holds, where P is an offset of said pitch control tool with respect to a reference plane corresponding to a zero pitch, ΔP is the displacement of said pitch control tool, D is the distance between said pitch control tool and outer diameter control roller, ΔD is the displacement of said outer diameter control roller, and A is a constant value.

2. A method according to claim 1, wherein said coil spring is wound in such a manner that at least one end of said coil spring is provided with an end turn portion wound substantially perpendicularly to said oblique axial line of said coil spring.

3. A method according to claim 1, wherein said coil spring is wound as a cold forming process.

4. A method according to claim 1, further comprising the step of applying a second outer diameter control roller to said rod member from a third direction which is on a same plane as said first direction.

* * * * *